US005446797A

United States Patent [19]

Paddock

[11] Patent Number: 5,446,797

[45] Date of Patent: Aug. 29, 1995

[54] AUDIO TRANSDUCER WITH ETCHED VOICE COIL

[75] Inventor: Paul W. Paddock, McMinnville, Oreg.

[73] Assignee: Linaeum Corporation, Portland, Oreg.

[21] Appl. No.: 322,108

[22] Filed: Oct. 12, 1994

Related U.S. Application Data

[63] Continuation of Ser. No. 916,038, Jul. 17, 1992, abandoned.

[51] Int. Cl.[6] ..... H04R 25/00

[52] U.S. Cl. ..... 381/192; 381/199; 381/201

[58] Field of Search ..... 381/199, 192, 196, 202, 381/203; 29/625

[56] References Cited

U.S. PATENT DOCUMENTS

| | | | |
|---|---|---|---|
| 3,350,513 | 10/1967 | Roberts . | |
| 3,754,322 | 8/1973 | Chandler . | |
| 3,919,499 | 11/1975 | Winey . | |
| 4,281,223 | 7/1981 | Ugaji et al. | 381/202 |
| 4,317,965 | 3/1982 | Toyoda . | |
| 4,465,906 | 8/1984 | Adolph et al. . | |
| 4,584,439 | 4/1986 | Paddock . | |
| 4,609,784 | 9/1986 | Miller | 381/195 |
| 4,653,103 | 3/1987 | Mori et al. | 381/196 |
| 4,903,308 | 2/1990 | Paddock et al. . | |
| 5,127,060 | 6/1992 | Paddock . | |

FOREIGN PATENT DOCUMENTS

| | | |
|---|---|---|
| 492142A2 | 11/1991 | European Pat. Off. . |
| 1180456 | 6/1959 | France . |
| 3001873 | 7/1981 | Germany . |
| 3804024A1 | 8/1989 | Germany . |
| 52-4228 | 1/1977 | Japan . |
| 58-173999 | 6/1983 | Japan . |
| 60-214198 | 10/1985 | Japan . |
| 61-101196 | 5/1986 | Japan . |
| 61-93798 | 12/1986 | Japan . |
| 63-13634 | 1/1988 | Japan . |
| 3-201796 | 3/1991 | Japan . |
| 3-262300 | 11/1991 | Japan . |
| 705100 | 9/1952 | United Kingdom . |
| 1002128 | 4/1965 | United Kingdom . |
| WO90/04317 | 4/1990 | WIPO . |

OTHER PUBLICATIONS

"Permanent Magnets Have Four Major Job", Charles A. Maynard. Nov. 1944.

Brochure entitled "Aurasound," Aura Systems, Inc., 2335 Alaska Avenue, El Segundo, California 90245 (1993).

*Primary Examiner*—Curtis Kuntz
*Assistant Examiner*—Sinh Tran
*Attorney, Agent, or Firm*—Klarquist Sparkman Campbell Leigh & Whinston

[57] ABSTRACT

An audio transducer having a voice coil formed by an etched, flexible circuit having an elongated, oblong spiral loop and rolled into a cylindrical tube. The coil cooperates with a magnetic structure including a circular, central magnet having a front north pole plate and rear south pole plate sized to fit closely within the cylindrical coil, and an annular outer magnet having a south front pole plate and a north rear pole plate aligned with the pole plates of the central magnet. The aligned magnets define annular front and rear magnet gaps between the respective front and rear pole plates with front and rear radial magnetic fields of opposite polarity formed across the respective magnet gaps. The spiral pattern etched on the coil is configured so that current flowing in the front portion of the coil within front gap magnet flows in an opposite orbital direction from current flowing in the rear portion of the coil within the rear magnet gap. Consequently, the forces acting on the coil act in concert to create the desired transducer motion.

17 Claims, 2 Drawing Sheets

54
56
50
12
16
14
52
20
22
24
38
40
36
30
28
32
S
N
150
102
104
64
96
74
10

AUDIO TRANSDUCER WITH ETCHED VOICE COIL

This application is a continuation of application Ser. No. 07/916,038, filed on Jul. 17, 1992, now abandoned.

TECHNICAL FIELD

This invention generally relates to audio transducers. More particularly, the invention relates to improvements in the design of a transducer having a cylindrical voice coil.

BACKGROUND OF THE ART

Cylindrical voice coils are commonly used on audio transducers such as cone drivers, dome tweeters, and microphone transducers. Typically, a cylindrical voice coil is suspended in a magnetic field, physically attached to a sound-generating diaphragm, and electrically connected to a signal source. The voice coil is usually a thin-walled tube having fine wire closely wrapped about the tube in a helical pattern. Glue is applied to secure the wire. A magnet structure provides an annular gap to receive the coil, with a radial magnetic field spanning across the gap to generate axial forces on the coil as a varying signal current flows through the coil. The conventional magnet structure is formed by a doughnut magnet having a front surface at a first polarity and a rear surface at the opposite polarity. An annular pole plate is attached to the front surface; a circular pole plate is attached to the rear surface, and includes an iron plug protruding forwardly through the doughnut hole to a position flush with the front surface of the front annular pole plate. Together, the plug and the front pole plate define an annular gap for receiving the coil. Magnetic field lines extend radially across the gap, with magnetic flux moving radially in only one direction.

A wire wound coil has several disadvantages. While other components of conventional cone transducers may otherwise be manufactured and assembled using highly automated processes, coil winding is more labor and skill intensive. Winding defects readily occur, often resulting in a significant number of rejected units that might not be discovered until after the product is completely assembled. To avoid excessive defects, coil winding machinery must operate at a limited speed. One type of failure mode common in wire coils is an imperfect wrap caused by a gap or overlap between adjacent wire loops. An overlapping wire may contact the magnet structure, resulting in unacceptable performance and eventual product failure during use.

Wire coil transducers have difficulty handling heat generated in the coil. During operation, current flowing through the coil generates heat that must be dissipated to prevent the coil from reaching excessive temperatures. The round wires employed in conventional voice coils have a relatively low surface area, and are therefore inefficient radiators. More important, the adhesive required to secure the wire to the core tube is vulnerable to failure at high temperatures. This failure can result in detachment of the wire. Even without detachment, thermal stresses may cause warpage of the entire voice coil, which may also result in catastrophic failure of the device.

It is believed that extensive efforts have been made throughout the audio industry to avoid the problems of wire coils by attempting to develop a more manufacturable alternative. Attempts may have been made to create flexible circuits, form them into cylindrical tubes, and provide numerous electrical connections at the junction between the two ends of the film to provide a helical conductor. Other attempts may have been made to deposit conductive material in a helical pattern on the interior or exterior surfaces of a thin walled tube. Apparently, none of these attempts has provided a suitable substitute for conventional voice coils.

SUMMARY OF THE INVENTION

The primary object of this invention is to provide an improved audio transducer having a voice coil that may be reliably manufactured using highly automated processes.

It is a further object of the invention to provide a voice coil that is readily manufacturable of highly heat resistant material.

It is a further object of the invention that the voice coil be configured to readily radiate heat.

These objects may be satisfied by providing a transducer having a voice coil etched from a copper clad flexible sheet of printed circuit material, which is then curved to form a tube shape. The coil is etched to form the pattern of an elongated oblong spiral formed of a single trace having numerous closely spaced loops. The spiral includes two spaced-apart straight elongated paths, designated "front" and "rear" conductor paths. Each path including a group of closely spaced loop segments. The ends of the otherwise flat sheet are connected to each other to form a tube. Consequently, current flowing through the coil at any instant will create current flow in one orbital direction through one of the paths, and in the opposite orbital direction through the other path.

To achieve useful speaker motion, the first coil path must be positioned in a radial magnetic field of a first polarity, with the second path positioned in a radial magnetic field of the opposite polarity. These fields are provided by a magnet structure having a doughnut magnet surrounding a central magnet. The doughnut magnet has a front-.to-rear polarity opposite that of the central magnet. Front and rear pole pieces on each of the magnets define front and rear magnet gaps for receiving the coil, with the front and rear conductor paths positioned in the respective gaps. A doubled net force acts on the coil due to the opposite current flow through the paths and the corresponding opposite magnetic fields.

DETAILED DESCRIPTION OF THE INVENTION

Figure 1:
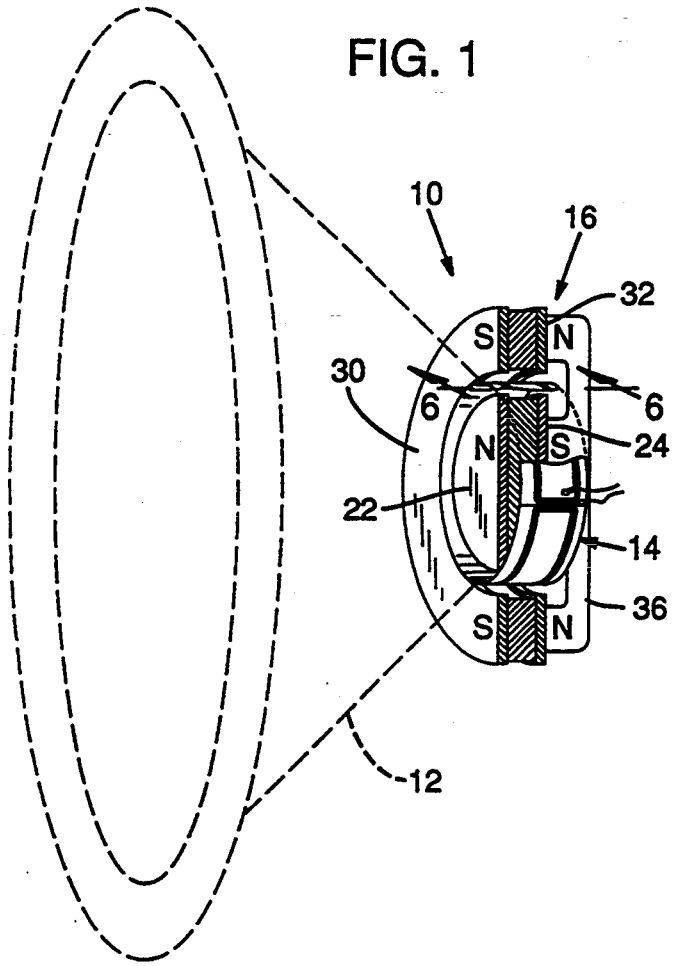
FIG. 1 is a cut-away isometric view of a transducer in accordance with a first embodiment of the present invention.

FIG. 1 illustrates a loudspeaker 10 having a cone diaphragm 12 attached to an acoustic member such as a cylindrical voice coil 14. A magnet structure 16 closely surrounds and centrally occupies the voice coil, creating magnetic fields in which the voice coil is suspended.

Figures 2, 7, 8, 9, 10:
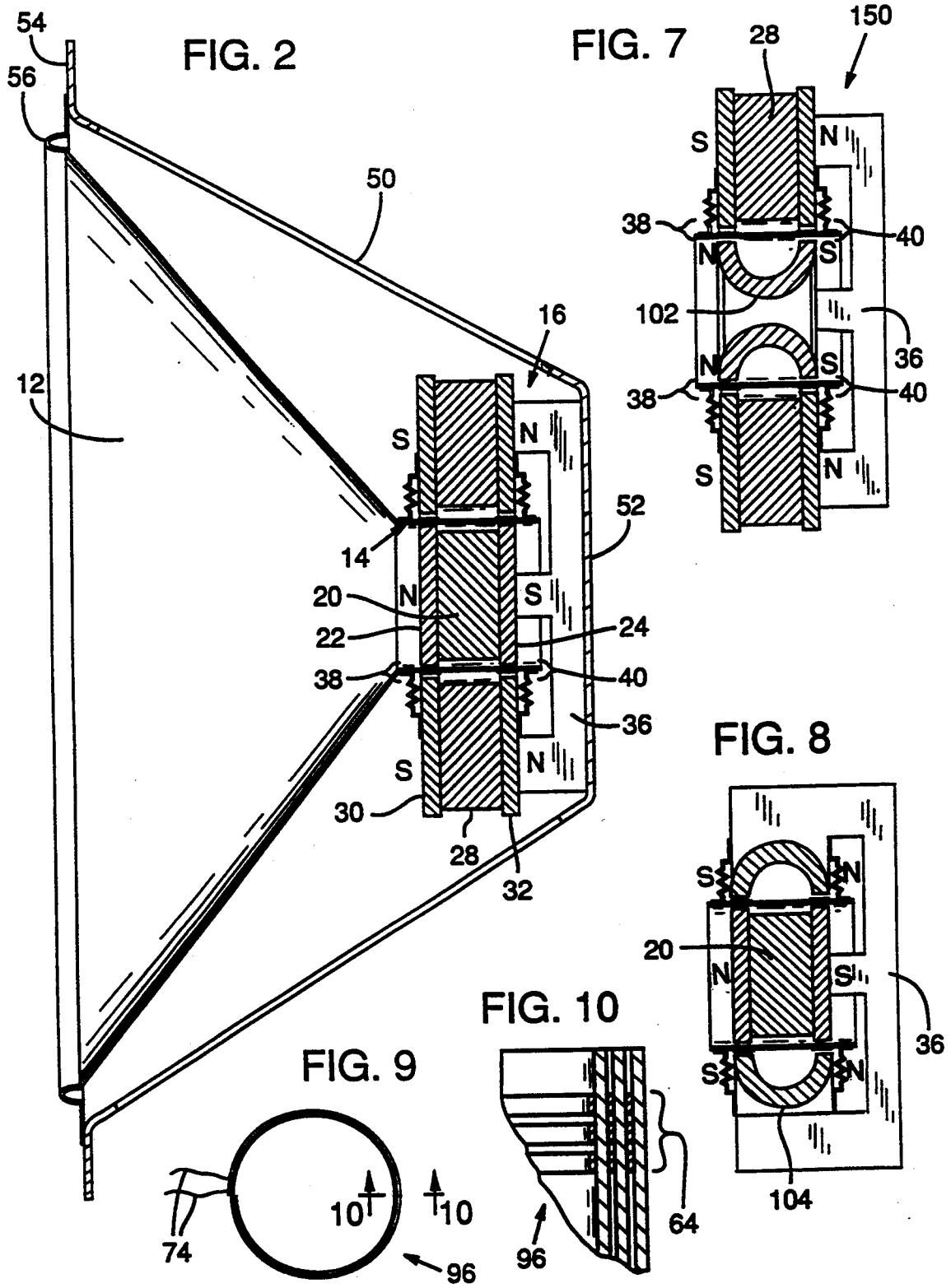
FIG. 2 is a sectional side view of the transducer of FIG. 1.
FIG. 7 is a cross sectional side view of an alternative magnet structure and coil according to a third embodiment of the present invention.
FIG. 8 is a cross sectional side view of an alternative magnet structure and coil according to a fourth embodiment of the present invention.
FIG. 9 is a front view of an assembled voice coil having multiple overlapping layers according to a fifth embodiment of the present invention.
FIG. 10 is an enlarged cross sectional side view taken along line 10—10 of FIG. 9.

As shown in FIG. 2, the magnet structure 16 includes a central magnet element 20 having a central front pole plate 22 and a central rear pole plate 24 attached, respectively, to front and back surfaces of the central element 20. The central element has an overall cylindrical shape to fit closely within the voice coil 14 without contacting it. An annular outer magnet element 28 having an outer front pole plate 30 and an outer rear pole plate 32 closely surrounds the voice coil 14. The central magnet element 20 and outer magnet element 28 are secured at their rear sides to a non-ferrous bridge 36 so that the magnet elements generally occupy the same plane. Suitable non-ferrous materials include brass, aluminum, and plastics. Consequently, the front pole plates 22 and 30 are coplanar and define a narrow annular front magnet gap 38, and the rear pole plates 24 and 32 similarly define a corresponding rear magnet gap 40.

Figure 6:
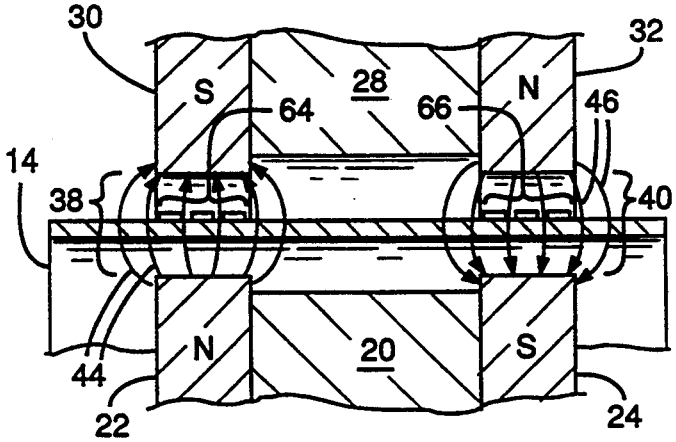
FIG. 6 is an enlarged cross sectional view of one portion of the voice coil and magnet gap of the embodiment of FIG. 1.

The central magnet element 20 and outer magnet element 28 are oppositely polarized. In the illustrated embodiment, the central front pole plate 22 and outer rear pole plate 32 are north poles, and the central rear pole plate 24 and outer front pole plate 30 are south poles. Accordingly, as shown in FIG. 6, magnetic flux flows radially outward from the central front pole plate 22 to the outer pole plate 30 along front magnetic field lines 44, which span the front magnetic gap 38. Magnet flux flows radially inward from the outer rear pole plate 32 toward the central rear pole plate 24 across the rear magnet gap 40 along rear magnetic field lines 46.

As further shown in FIG. 2, the loudspeaker 10 includes a rigid frame 50 having a rear section 52 secured to the bridge 36, and a front flange 54 attached to the front peripheral edge of the cone 12. The cone 12 includes a flexible surround 56 to permit piston-like motion to generate sound.

Figure 4:
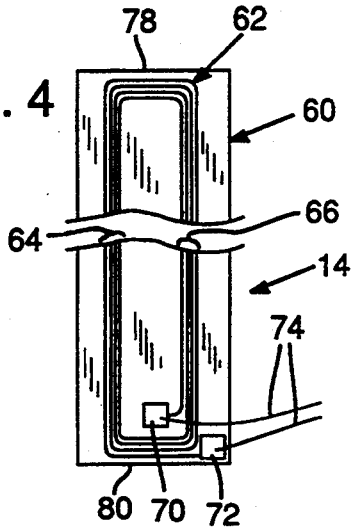
FIG. 4 is a plan view of the voice coil of FIG. 3 shown in an unassembled flat configuration.

FIG. 4 shows the voice coil 14 as a planar sheet prior to being formed to a cylindrical shape. The voice coil 14 includes an elongated rectangular substrate 60 of a thin, flexible high-temperature material such as glass-epoxy or Kapton® film (manufactured by DuPont). A conductive pattern 62 is provided on at least one face of the substrate, and preferably forms an elongated oblong spiral trace having numerous adjacent concentric loops. Although illustrated with only three or four loops, the preferred embodiment includes between four and eight loops. The pattern 62 includes a straight front path 64 running substantially the entire length of the sheet 60 and including a group of closely spaced parallel loop segments. A similar rear path 66 is spaced apart from the front path by a distance comparable to the space between the front and rear magnet pole plates. The conductive pattern 62 includes an inner contact pad 70 and an outer contact pad 72, with each pad being connected to an opposite end of the conductive spiral trace. Accordingly, with lead wires 74 connected to the respective paths, current may be passed through the conductive pattern 62. Because of the spiral configuration, current flowing at any given moment flows in opposite directions through the respective front and rear paths 64, 66 as it circulates through the pattern.

Figure 3:
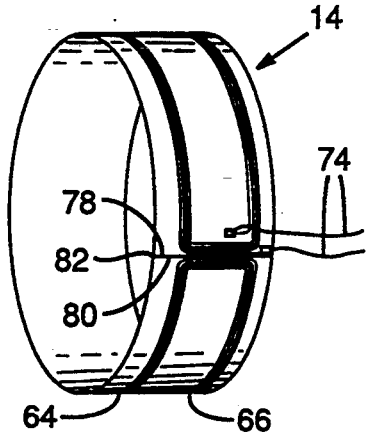
FIG. 3 is an isometric view of the voice coil of the embodiment of FIG. 1 shown in an assembled tubular configuration.

The substrate 60 terminates at first and second ends 78, 80, which are joined together at junction 82 as shown in FIG. 3 to form the assembled cylindrical coil 14. The ends are joined by attachment means (not shown) such as tape, glue, welding, or a mechanical fastener. As a consequence of the tubular shape, current flowing through the coil at any given moment will flow in contrary circular orbital directions through the respective front and rear paths 64, 66. For example, as shown in FIG. 6, when current flows "into the page" in the traces of the front path 64, it must flow "out of the page" through the traces of rear path 66.

FIG. 6 further shows that the front and rear paths 64, 66 are spaced apart by an amount generally equal to the spacing between the front plates and the rear plates of the magnet structure 16 so that the paths 64, 66 are positioned within the respective front magnet gap 38 and rear magnet gap 40.

It is apparent from FIG. 3 that the paths 64 and 66 do not completely encircle the coil 14 because the conductive pattern 62 does not cross the junction 82. The spiral pattern avoids the need for electrical connections across the junction, and provides effective operation of the coil in the magnetic fields generated by the magnet structure 16 because the nearly complete circular paths function as complete helical coils.

The voice coil 14 of the preferred embodiment is manufactured from a copper-clad sheet of flexible material. Using conventional printed circuit manufacturing techniques, the spiral pattern is etched in the copper cladding and subsequently plated with tin or coated with an oxide-inhibiting film to prevent corrosion. These manufacturing techniques are very well known and provide very uniform dimensions. The preferred embodiment is formed of material clad with one-half ounce copper foil, although a wide range of thickness may be used, depending on the application. One ounce foil may be used where lower impedance is desired. The typical trace width may be in the range of 0.003 to 0.015 inch, with 0.010 inch being preferred. Spacing between adjacent traces is ideally as narrow as possible, with 0.005 inch being preferred due to current manufacturing limitations.

Figure 5:
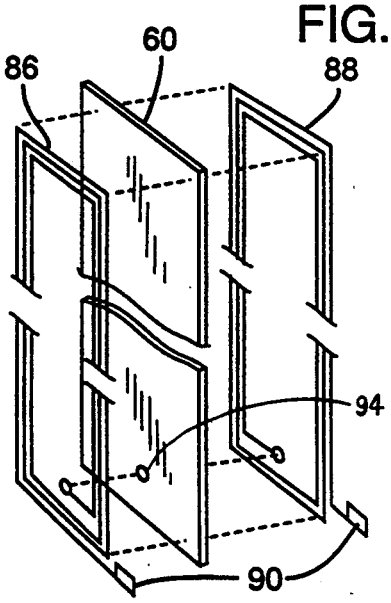
FIG. 5 is an exploded view of a two sided voice coil in a flat configuration in accordance with a second alternative embodiment of the present invention.

FIG. 5 shows an alternative embodiment double-sided coil having a first spiral trace 86 and a second spiral trace 88 on opposite sides of the substrate. The outer terminus of each trace is connected to a connector pad 90, and the inner ends are connected to each other via a plated conductive through-hole 94. The spirals on each side are oriented to carry current in the same orbital direction to avoid cancelling the other's effects. This permits effectively twice as many conductive loops, which provides increased efficiency for a given power input. In addition, heat dissipation is improved because both sides may be exposed to air.

FIG. 9 illustrates an additional alternative embodiment voice coil 96 that may be formed from a single-sided etched sheet having a length several times the desired circumference of the finished voice coil. The elongated sheet is rolled up to form a tube having a wall thickness of several layers. FIG. 10 illustrates such an embodiment having a wall thickness of three layers with a single-sided sheet as shown. It is not necessary to provide additional insulation layers, because the conductive traces contact only the insulating substrate layer.

The single-sided, multi-layer embodiment has the advantage of improved dimensional and mechanical stability due to the inherent tendency of film to form a rigid tube when overlapped as shown. The double-sided embodiment of FIG. 5 does not lend itself to such an overlapped configuration without an intermediate insulating layer, but when used as a single layer it has the advantage of effective heat dissipation. The single-sided, non-overlapped configuration of FIG. 3 also provides effective heat dissipation, and may be used where large numbers of wire loops would not be required. To provide rigidity and stability in the non-overlapped versions such as shown in FIG. 3, a rigid disk or ring (not shown) may be inserted within the cylindrical coil to maintain a controlled circular cross section.

FIGS. 7 and 8 illustrate embodiments of the magnet structure suitable for low cost or light weight applications in which a limited strength magnetic field is adequate. In each embodiment, a magnet element is replaced by a magnetic-flux-transmitting ring formed of a ferrous material such as iron or low carbon steel. FIG. 7 shows a magnet structure 100 including the bridge 36 and outer magnet 28 of the preferred embodiment. An inner flux-transmitting ring 102 is rigidly attached to the center of the bridge. The ring 102 preferably has an outwardly facing C-shaped cross section, but may alternatively take any of a variety of forms, including a solid cylindrical plug. The outer magnet 28 magnetizes the ring 102 to create the desired magnetic fields across the magnet gaps 38 and 40.

Similarly, as shown in FIG. 8, the bridge 36 is connected to the central magnet element 20 of the type shown in the preferred embodiment. An outer flux-transmitting ring 104 having an inwardly facing C-shaped cross section is attached to the bridge. The ring 104 opposes magnetic pole plates to form the magnet gaps, thereby becoming sufficiently magnetized to create the necessary magnetic fields.

For certain unusual applications, it may be necessary to avoid any imbalance of forces acting on the coil. The portion of the voice coil nearest the junction does not contribute a driving force and therefore may need to be balanced by a comparable region halfway around the coil. This may be achieved by providing a notch (not shown) in the pole plates to provide a reduced magnetic field to reduce the driving force on the side opposite the junction. Other options include adjusting the spiral pattern so that the paths detour briefly toward the center of the substrate at a position opposite the junction, so that there is no current flowing with the magnet gap at those detoured locations. In the applications contemplated, however, these precautions should not be necessary to achieve satisfactory performance.

It will be appreciated that while the voice coil is shown in a configuration having a circular cross section, other cross sectional profiles may be used in conjunction with magnet structures having appropriately configured magnet gaps. It is also contemplated that the invention may be employed in applications unrelated to audio transducers, including applications that currently employ linear actuators having wire wound coils for interacting with a magnetic field.

A further embodiment contemplated for applications not requiring high efficiency employs a voice coil as shown in the preferred embodiment, but with a conventional doughnut magnet structure (not shown) having only a single radial magnetic field. The coil is positioned farther forward than in the preferred embodiment, so that only the rear path is positioned in the magnet gap. The front path is positioned well forward of the magnet structure to avoid interaction between the front path and the magnetic field. The coil may be enlarged to increase the space between the front and rear paths to provide clearance. The front path traces may further be enlarged to reduce impedance.

Having illustrated and described the principles of my invention by what is presently a preferred embodiment, it should by apparent to those persons skilled in the art that the illustrated embodiment may be modified without departing from such principles. My invention, not only the illustrated embodiment, but all such modifications, variations, and equivalents thereof falls within the true spirit and scope of the following claims.

I claim:

1. An audio transducer comprising:

(a) a frame;

(b) a magnet structure attached to the frame, the magnet structure having a central portion with a forward part of a first polarity and a rearward part of a second polarity opposite the first polarity, and an outer portion in circumferential relationship to the central portion, the outer portion having a forward part of the second polarity and a rearward part of the first polarity, the forward parts defining a forward magnet gap between the central and outer portions, and the rearward parts defining a rearward magnet gap between the central and outer portions;

(c) a voice coil movably positioned within the forward magnet gap and the rearward magnet gap, the voice coil being connectable to a source of electric current so as to allow passage of electric current from the source through the voice coil and thereby cause the voice coil to move relative to the magnet structure, the voice coil comprising a looped electrical conductor having a first portion situated in the forward magnet gap and oriented so as to conduct electric current in a first direction relative to the magnet structure, and a second portion situated in the rearward magnet gap and oriented so as to conduct electric current in a second direction, opposite the first direction, relative to the magnet structure; and (d) an acoustic member attached to the voice coil and flexibly attached to the frame so as to enable the acoustic member to move in a manner sufficient to generate sound in response to the electric current passing from the source through the voice coil.

2. The transducer of claim 1 wherein the voice coil comprises an electrically insulative sheet layer with etched conductive tracings thereon in a looped configuration so as to form the first and second portions of the electrical conductor, the sheet layer being curved to form a tube circumferentially around which the first and second portions of the electrical conductor extend in opposite directions.

3. The transducer of claim 2 wherein the voice coil comprises multiple sheet layers.

4. The transducer of claim 1 wherein the acoustic member comprises a diaphragm.

5. The transducer of claim 1 wherein the magnet gaps are annular.

6. An audio transducer comprising:

a frame;

a magnet structure attached to the frame, the magnet structure defining a gap across which a first and a second magnetic flux separately extend in a radial manner, the first magnetic flux being oriented oppositely the second magnetic flux;

an electrically conductive voice coil positionable within the gap, the voice coil comprising a first coil portion and a second coil portion, the voice coil being connectable to a source of electric current such that the current flows from the source through the first coil portion in a first orbital direction in the first magnetic flux and from the source through the second coil portion in a second orbital direction, oppositely the first orbital direction, in the second magnetic flux; and an acoustic member attached to the voice coil and flexibly attached to the frame so as to enable the acoustic member to move in a manner sufficient to generate sound in response to the electric current flowing from the source through the voice coil.

7. The transducer of claim 6 wherein the voice coil comprises an electrically insulative sheet layer with etched conductive tracings thereon in a looped configuration so as to form the first and second portions of the electrical conductor, the sheet layer being curved to form a tube circumferentially around which the first and second portions of the electric conductors extend in opposite directions.

8. The transducer of claim 7 wherein the voice coil comprises multiple sheet layers.

9. An audio transducer comprising:

a frame;

a magnet structure attached to the frame, the magnet structure having a central portion with a forward part of a first polarity and a rearward part of a second polarity opposite the first polarity, and an outer portion in circumferential relationship to the central portion, the outer portion having a forward part of the second polarity and a rearward part of the first polarity, the forward parts of the central and outer portions defining an annular forward magnet gap between the central and outer portions and the rearward parts of the central and outer portions defining an annular rearward magnet gap between the central and outer portions;

a cylindrical voice coil having a forward electrically conductive coil portion positionable within the forward magnet gap and a rearward electrically conductive coil portion positionable within the rearward magnet gap, the voice coil being connectable to a source of electric current so as to allow electric current to flow from the source in a first orbital direction in the forward coil portion and in a second orbital direction, oppositely the first orbital direction, in the rearward coil portion; and an acoustic member attached to the voice coil and flexibly attached to the frame so as to enable the acoustic member to move in a manner sufficient to generate sound in response to the electric current flowing from the source through the voice coil.

10. The transducer of claim 9 wherein the voice coil comprises an electrically insulative sheet layer with etched conductive tracings thereon forming the forward and rearward electrically conductive portions, the sheet layer being curved to form a tube circumferentially around which the forward and rearward electrically conductive portions extend.

11. The transducer of claim 10 wherein the voice coil comprises multiple sheet layers.

12. The transducer of claim 9 wherein the acoustic member comprises a cone diaphragm.

13. A method of constructing an audio transducer, comprising the steps:

(a) forming, on a longitudinally extended electrically insulative substrate having opposing ends, an electrically conductive tracing of longitudinally extended concentric spiral loops, the loops being electrically connected in series to each other and collectively comprising a first group of longitudinally extended adjacent loop segments adapted to conduct electric current from a source in a first direction through the first group of loop segments, and a second group of longitudinally extended adjacent loop segments substantially parallel to the first group, the second group being spaced apart from the first group and adapted to conduct electric current from the source in a second direction, oppositely the first direction, through the second group of loop segments, the first and second groups of loop segments being joined together at each end of the substrate by first and second loop ends, respectively;

(b) forming an electrically conductive voice coil by bending the substrate to substantially form a tube such that the first and second groups of loop segments extend circumferentially around the tube;

(c) attaching an end of the voice coil to an acoustic member;

(d) providing a magnetic structure having a first field region producing a radially directed first flux and a second field region producing a second flux, the first flux being oriented oppositely the second flux; and (e) placing the voice coil relative to the magnetic structure such that the first group of loop segments resides in the first flux and the second group of loop segments resides in the second flux.

14. The method of claim 13 wherein step (b) comprises overlapping the substrate with itself to form a tube having a wall thickness of multiple layers.

15. The method of claim 13 wherein step (a) comprises providing a longitudinally extended electrically insulative substrate clad with a conductive layer, and etching a pattern defining the electrically conductive tracing of spiral loops in the conductive layer.

16. The method of claim 13 wherein step (a) comprises printing the electrically conductive tracing of spiral loops on the substrate.

17. An audio transducer, comprising:

(a) a magnet structure having a central magnet element and an outer magnet element situated circumferentially relative to the central magnet element and spaced apart from the central magnet element so as to define a gap therebetween, the central and outer magnet elements being magnetically oriented relative to each other so as to define first and second magnetic fluxes radially extending separately across the gap, wherein the first magnetic flux has an orientation opposite to the second magnetic flux;

(b) a voice coil connectable to a source of electric current so as to allow current to flow from the source through the voice coil, the voice coil comprising first and second electrical conductors each extending so as to conduct the current circumferentially in the gap in opposite directions and cause the first and second electrical conductors to magnetically interact with the first and second magnetic fluxes, respectively, the voice coil being adapted to move in the gap relative to the central and outer magnet elements whenever electric current is passing through the first and second electrical conductors; and (c) an acoustic member attached to the voice coil so as to be moved by the voice coil whenever the voice coil is moving relative to the magnet structure.

* * * * *

UNITED STATES PATENT AND TRADEMARK OFFICE

CERTIFICATE OF CORRECTION

PATENT NO. : 5,446,797

DATED : August 29, 1995

INVENTOR(S) : PAUL W. PADDOCK

It is certified that error appears in the above-identified patent and that said Letters Patent is hereby corrected as shown below:

Column 2, line 43, "front-.to-rear" should be --front-to-rear--.

Column 6, line 22, delete "My" and in lieu thereof insert --I claim that my--.

<u>In the Claims:</u>

Column 7, line 35 (our file, last line of claim 7), "electric" should be --electrical--.

Signed and Sealed this

Fourteenth Day of May, 1996

*Attest:*

Bruce Lehman

BRUCE LEHMAN

*Attesting Officer*

*Commissioner of Patents and Trademarks*